US010141152B2

(12) United States Patent
Brockwell

(10) Patent No.: US 10,141,152 B2
(45) Date of Patent: Nov. 27, 2018

(54) DRIFT CHAMBER CONNECTION METHODS AND APPARATUS

(71) Applicant: Michael Ian Brockwell, Santa Fe, NM (US)

(72) Inventor: Michael Ian Brockwell, Santa Fe, NM (US)

( * ) Notice: Subject to any disclaimer, the term of this patent is extended or adjusted under 35 U.S.C. 154(b) by 59 days.

(21) Appl. No.: 15/298,195

(22) Filed: Oct. 19, 2016

(65) Prior Publication Data

US 2017/0108592 A1 Apr. 20, 2017

Related U.S. Application Data

(60) Provisional application No. 62/243,663, filed on Oct. 19, 2015.

(51) Int. Cl.
*H01J 5/32* (2006.01)

(52) U.S. Cl.
CPC ..... *H01J 5/32* (2013.01)

(58) Field of Classification Search
CPC .. H01J 23/20; H01J 31/286; H01J 5/32; H01J 65/048
See application file for complete search history.

(56) References Cited

U.S. PATENT DOCUMENTS 6,307,156 B1 * 10/2001 Avellanet ..... B21C 37/045 174/128.1
2013/0009053 A1 * 1/2013 Wu ..... G01N 27/622 250/282

* cited by examiner

*Primary Examiner* — David Porta
*Assistant Examiner* — Faye Boosalis
(74) *Attorney, Agent, or Firm* — Franklin & Associates International Inc; Matthew Lambrinos

(57) ABSTRACT

Chamber connection methods and apparatus are provided. In some embodiments, a signal wire is attached to a drift chamber by feeding a signal wire through an end of the drift chamber; feeding the signal wire through the dielectric tube; extending the dielectric tube outwardly from the drift chamber end; and at a location on the outside of the drift chamber end, setting the extending dielectric tube and signal wire together to thereby fit the signal wire to the drift chamber end and gas seal the dielectric tube end. In some other embodiments, the drift chamber is a muon drift tube. In some embodiments, drift tube end cap assemblies with and without gas ports are provided for attaching the signal wire to the drift tube.

17 Claims, 7 Drawing Sheets

DRIFT CHAMBER CONNECTION METHODS AND APPARATUS

CROSS REFERENCE TO RELATED APPLICATIONS

This application claims the benefit of U.S. provisional patent application Ser. No. 62/243,663 filed Oct. 19, 2015, the disclosure of which is incorporated herein by reference in its entirety.

STATEMENT REGARDING FEDERAL RIGHTS

N/A

TECHNICAL FIELD

Embodiments relate to gas vessel connection methods, and more particularly but not exclusively to drift chamber connection methods. Embodiments relate to drift chamber electrical and mechanical connection apparatus, and more particularly but not exclusively to drift tube electrical and mechanical connection apparatus.

BACKGROUND

Engineers who need to pass power and signal wires through the walls of pressure and vacuum chambers usually reach for expensive, off-the-shelf, sealed bulkhead connectors. Though bulkhead connectors are the most readily available option, their expense is not only relatable to the connectors themselves, but the work that must go into the design in order to compensate for their large size. Ultimately, the use of such connectors raises costs and can also cause electrical disturbances within the vacuum chambers. As a better alternative, hermitically sealed, epoxy, feed-throughs are being used due to their inexpensive nature in comparison to bulkhead connectors. Yet, there are disadvantages to this technology as well.

Hermetically sealed, epoxy, feed-throughs are messy and difficult to work with, require special consideration to reduce air bubbles and irregularities in the epoxy during the setting process, also may require lengthy periods of time to set. Outgassing of the epoxy can also cause problems in extremely pure environments. The problem with bulkhead connectors is that they are expensive and brittle. Feed-throughs using epoxy have at least the following limitations: one-time use, brittle, messy and difficult to work with, expensive to produce due to time of setting, extensive outgassing of epoxy chemical considerations for contaminating sterile environments.

Due to the limited options available for chamber feed-throughs a need for an alternative arises.

SUMMARY

According to one aspect, a method for attaching a signal wire to a drift chamber can comprise feeding a signal wire through an end of a drift chamber; feeding the signal wire through the dielectric tube; extending the dielectric tube outwardly from the drift chamber end; at a location on the outside of the drift chamber end, setting the extending dielectric tube and signal wire together to thereby fit the signal wire to the drift chamber end and gas seal the dielectric tube end.

According to another aspect, a drift chamber assembly may comprise a signal wire fed through an end of a drift chamber; a dielectric tube extending outwardly from the drift chamber end, the signal wire being fed through the extending dielectric tube; wherein, at a location on the outside of the drift chamber, the extended dielectric tube and signal wire are set together; the set together extended dielectric tube and signal wire forming a gas seal.

According to another aspect, a method for attaching a signal wire to a gas vessel may comprise feeding a signal wire through an end of a gas vessel; feeding the signal wire through the dielectric tube; extending the dielectric tube outwardly from the gas vessel; at a location on the outside of the gas vessel, setting the extending dielectric tube and signal wire together to thereby fit the signal wire to the gas vessel and gas seal the dielectric tube end.

According to yet another aspect, a method for attaching a signal wire to a gas vessel may comprise feeding a signal wire through an end of a gas vessel; feeding the signal wire through the dielectric tube; extending the dielectric tube outwardly from the gas vessel; and at a location on the outside of the gas vessel, setting the extending dielectric tube and signal wire together to thereby fit the signal wire to the gas vessel and gas seal the dielectric tube end.

According to yet another aspect, a gas vessel assembly may comprise a signal wire fed through a gas vessel; a dielectric tube extending outwardly from the gas vessel, the signal wire being fed through the extending dielectric tube; and wherein, at a location on the outside of the gas vessel, the extended dielectric tube and signal wire are set together; the set together extended dielectric tube and signal wire forming a gas seal.

LIST OF REFERENCE NUMERALS

Figure 1:
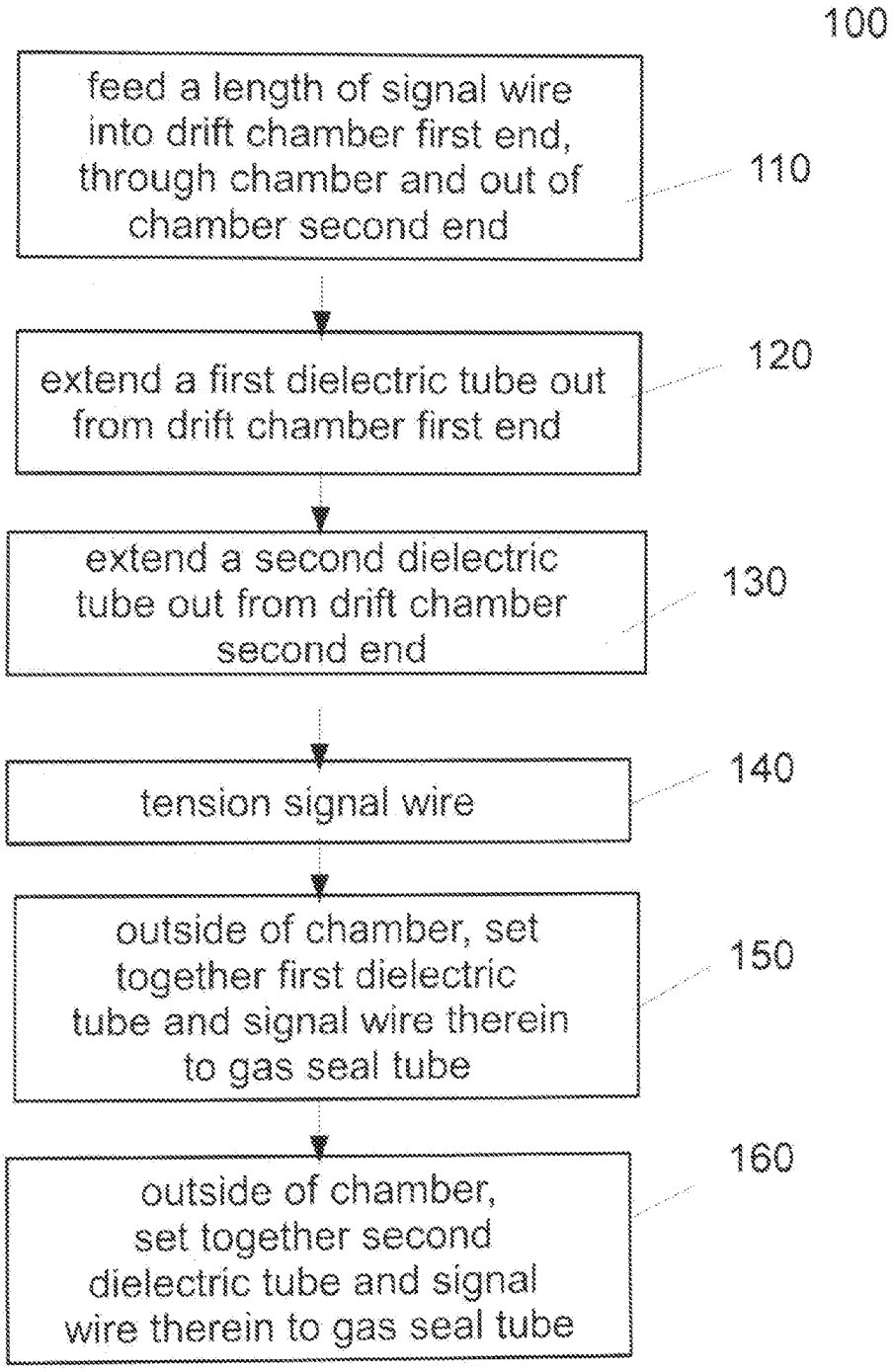
FIG. 1 is a flow chart outlining a method of fitting a signal wire to a drift chamber according to one embodiment.

1. Dielectric tube
2. Heat crimp
3. Electrical termination crimp
4. Electrical plug
5. Tensioned feed through wire
6. Compression fitting
7. Compression feral
8. Feed through wall
9. Tube/Chamber wall
10. Loose feed through wire
11. Gas or Liquid port

DETAILED DESCRIPTION OF THE PREFERRED EMBODIMENTS

In the following description, for purposes of explanation and not limitation, specific details are set forth, such as particular embodiments, procedures, techniques, etc. in order to provide a thorough understanding of the present invention. However, it will be apparent to one skilled in the art that the present invention may be practiced in other embodiments that depart from these specific details.

It has been identified that there is a need for an inexpensive, durable feed-through system for electrical wiring.

Technical features described in this application can be used to construct various embodiments of drift chamber, or other gas vessel, connection methods. Furthermore, technical features described in this application can be used to construct various embodiments of drift chamber, or other gas vessel, apparatus.

Reference will now be made to the drawings in which the various elements of embodiments will be given numerical designations and in which embodiments will be discussed so as to enable one skilled in the art to make and use the invention.

Specific reference to components, process steps, and other elements are not intended to be limiting. Further, it is understood that like parts bear the same reference numerals, when referring to alternate Figures. It will be further noted that the Figures are schematic and provided for guidance to the skilled reader and are not necessarily drawn to scale. Rather, the various drawing scales, aspect ratios, and numbers of components shown in the Figures may be purposely distorted to make certain features or relationships easier to understand.

Referring now to one aspect of the present technology, methods of connecting signal wires to drift chambers will now be described. FIG. 1 is a flow chart outlining a drift tube connection method according to one embodiment. Method 100 begins by feeding a length of signal wire into a first end of drift chamber and out of the second end of the drift chamber (s110). A first dielectric tube is extended out from the first end of the drift chamber with the signal wire extending therethrough (s120). In some embodiments, the drift chamber is a drift tube such as the drift tube shown in FIG. 2. In some embodiments, the drift tube is a carbon drift tube. In some other embodiments, the drift tube is an aluminum drift tube. Furthermore, in some embodiments, the dielectric tube is a plastic tube.

As shown in the flow chart of FIG. 1, method 100 continues by extending a second dielectric tube out from a second end of the drift chamber with the signal wire extending therethrough (s130). The signal wire is tensioned (s140). The first dielectric tube and signal wire therein under tension are then set and sealed together on the outside of the drift chamber so as to gas seal the first dielectric tube and secure the signal wire to the dielectric tube (s150). The second dielectric tube and signal wire therein under tension are then set together on the outside of the drift chamber so as to gas seal the second dielectric tube and secure the signal wire to the second dielectric tube (s160).

By extending the dielectric tubes out from the drift chamber ends, and setting the dielectric tubes and signal wires under tension together on the outsides of the drift chamber, the drift chamber is both securely fitted with the signal wire and gas sealed in a durable and inexpensive manner.

Method 100 is not limited to the sequence of processes set forth in FIG. 1. For example, in some embodiments, the length of wire may be fed through the tube and then the first dielectric tube and/or second dielectric tube threaded onto the signal wire preparatory to extending the first dielectric tube and/or second dielectric tube from the first tube end and/or second tube end, respectively. In other embodiments, s120 and/or s130 can be performed before s110.

Furthermore, s110 could be performed as two separate steps, that is, the length of signal wire may be fed through the first dielectric tube but not necessarily fed through the second dielectric tube until some other steps have been performed.

In some embodiments, the step 130 of extending the first dielectric tube from the first drift chamber end may be performed in different ways. For example, in some embodiments, the first dielectric tube is extended out from the first drift chamber end by means of a connector, such as a cap and swage lock nut and feral connector. In other embodiments, the first tube is extended out from the first drift chamber end by integrating the first dielectric tube into the first chamber end, such as for example by means of dielectric molding or 3D printing. In yet further embodiments, the first dielectric tube is extended out from the drift chamber first end itself rather than an end cap. For example, by way of example, a drift chamber first end cap is integrated into the drift chamber first end rather than being a separate cap that is attached to the drift chamber first end.

In some embodiments, the step of signal wire tensioning s140 is omitted. In yet other embodiments, the method processes s120 and/or s130 include(s) extending the dielectric tube inwardly from the drift chamber first end cap in addition to extending the tube out from the first end cap. In this manner, the dielectric tube extending inwardly into the drift chamber from the drift chamber end cap provides the drift chamber with a voltage stand off potential. The voltage stand off potential varies according to the length of the dielectric tube extending inwardly from the drift chamber end cap.

Similar method process variations described hereinbefore with respect to the first dielectric tube, drift chamber first end and drift chamber first end cap apply to the second dielectric tube, drift chamber second end and drift chamber second end cap. In some embodiments, the drift chamber is a drift tube. In some embodiments the drift tube is a muon drift tube made from graphite or other material, such as aluminum.

Figure 4:
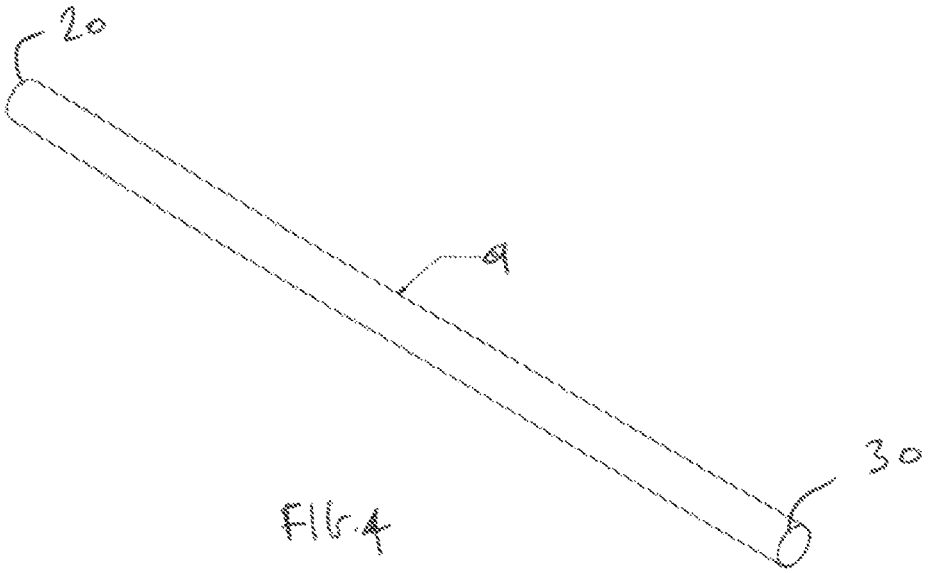
FIG. 4 is a perspective view of a drift tube according to one embodiment.
Figure 5:
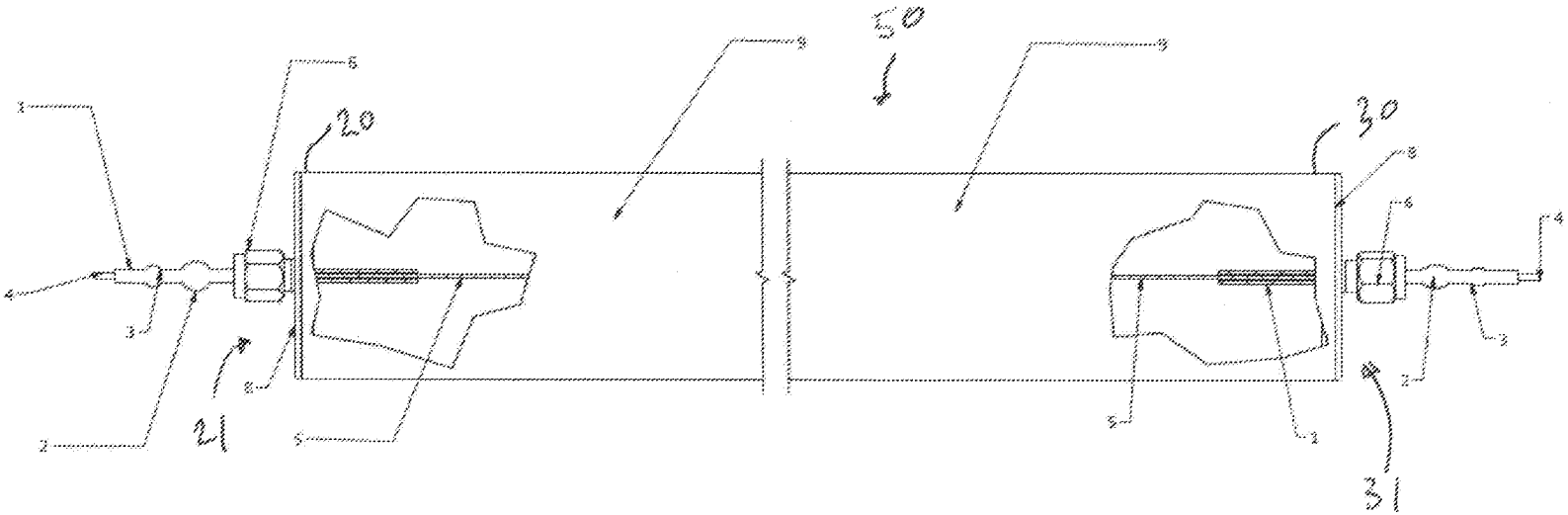
FIG. 5 is a perspective cut away of a drift tube assembly according to one embodiment.

In order to more adequately explain aspects of the present technology, reference will now be made to a drift chamber assembly according to some embodiments. Referring to accompanying FIG. 5, there is illustrated a side view of a drift chamber assembly according to one embodiment. In this embodiment, the drift chamber assembly 50 is for sub-atomic particle detection and tracking systems. The drift chamber assembly is a muon drift tube assembly. As illustrated in FIG. 4, which is a perspective view of a drift tube according to one embodiment, a drift tube 9 in the form of a hollow cylinder has a pair opposite ends (first end 20 and second end 30). In this embodiment, drift tube 9 is a carbon fiber or graphite drift tube. In other embodiments, the drift tube is aluminum or other material suitable for drift tube operation.

Drift tube assembly 50 also includes a first end cap assembly 21 fit to the drift tube first end 20, a second end cap assembly 31 fit to the drift tube second end 30. In this embodiment, first end cap assembly 21 and second end cap assembly 31 are the same design. However, in some other embodiments, the first end cap assembly 21 is of a different design from the second end cap assembly 31. Also included in the drift tube assembly is signal wire 5. Signal wire 5 extends from outside into the first drift tube end 20 via the first end cap assembly 21, along the length of the interior of the drift tube 9 and out of the drift tube second end 30 via the second end cap assembly 31 to the outside of the drift tube assembly.

Figure 2:
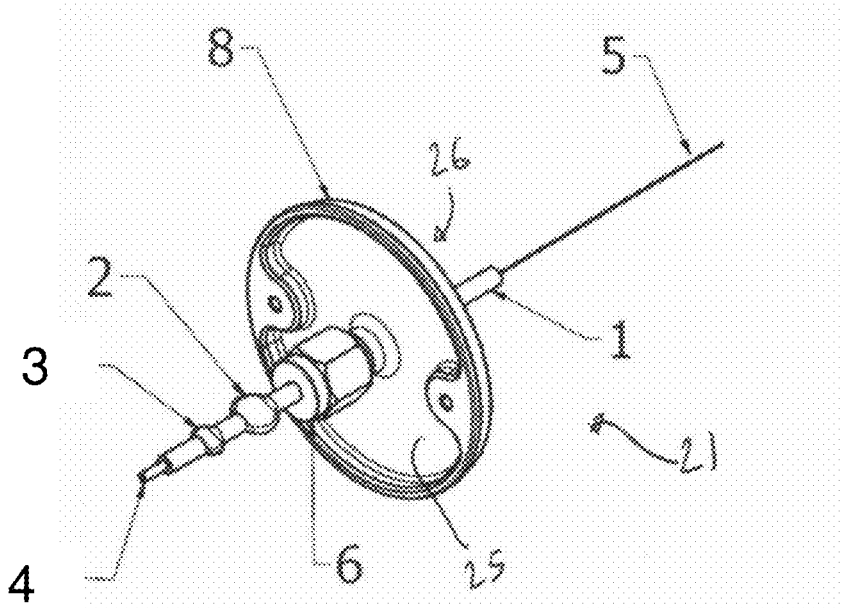
FIG. 2 is a perspective view of a drift tube end cap assembly according to one embodiment.
Figure 3:
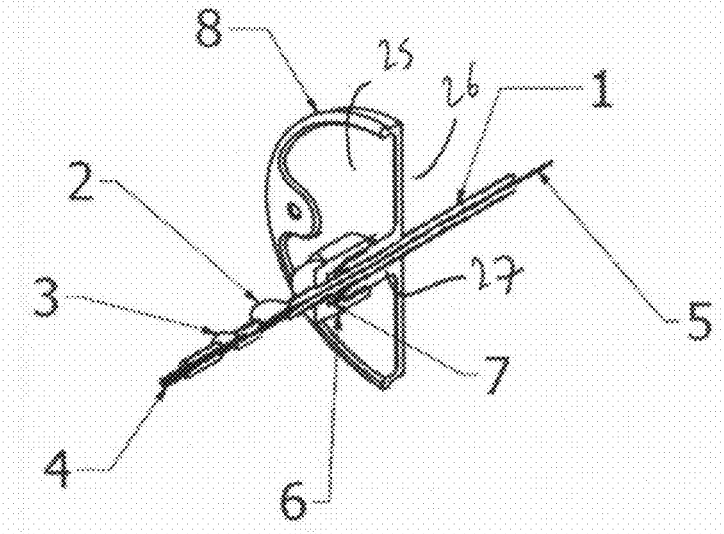
FIG. 3 is a side view of a drift tube end cap assembly fitted with a signal wire according to one embodiment.

As best illustrated in FIGS. 2 and 3, which illustrate perspective views of a drift tube end cap assembly according to one embodiment, the drift tube first end cap assembly 21 includes a compression fitting/ferrule type drift tube fitting composed of a compression fitting 6 and compression feral 7. Non-limiting examples of such fittings are tube fittings manufactured by Ermento, Betabite and Wade etc. Alternatively, the drift tube first end cap assembly 21 includes a Flared/Swaged type fitting or Oring/Retainer washer type fitting. Examples of Flared/Swaged type fittings are tube fittings manufactured by Parker Hannifin, Swagelock etc. Examples of Oring/Retainer washer type fittings are tube fittings manufactured by Keelaring (KR). Drift tube end cap assembly 21 also has feed through wall 8, a dielectric tube 1, heat crimp 2, electrical termination crimp 3, and electrical plug 4. Feed through wall 8, is a generally circular disc shape having an outer face 25 and inner face 26 opposite the outer face. Feed through wall 8 also includes a perimeter rim or lip extending generally perpendicular outwardly from the perimeter of the feedthrough wall outer face 25 for press fitting or plugging the feedthrough wall 8 into drift tube end 20 and hermitically sealing thereto.

Compression fitting 6 is in the form of a cylindrical body disposed coaxially with the feedthrough wall and extending outwardly from the feed through wall outer face 25. Compression fitting cylindrical body 6 has a cylindrical feed through passageway 27 extending along the central longitudinal axis of the body 6 between the feedthrough wall inner face 26 and the outer end of the compression fitting. Dielectric tube 1 is sized to be feedable through the feedthrough passage way 27. Tube 1 and the feedthrough wall 8 are hermitically sealable in coaxial relation by securing the compression feral 7 to the compression fitting 6. Once sealed in position, dielectric tube 1 extends through the feedthrough wall as shown for example in FIG. 3.

Dielectric tube 1 is either threaded on the signal wire 5 or the wire is fed through the dielectric tube. Dielectric tube 1 extends outwardly by a length sufficient to allow space for heat crimping of the dielectric tube to the signal wire 5 at a position on the outside of the drift tube and spaced away from the compression fitting. Dielectric tube 1 extends inwardly by a length sufficient for providing a required voltage stand off potential in the drift tube.

Embodiments of the present technology provide an inexpensive, durable feed-through system for electrical wiring. These electrical feed-throughs can be placed virtually anywhere on a vessel, adjusted for voltage stand off potential, tensioning of the feed-through wire, and possesses the opportunity to replace the individual feed-through if it happened to failed electrical or vacuum testing without needing to build an entirely new system.

The feed-through provided is capable of applying tension to a wire during the forming process. This gives the advantage of a known location and added stability which is limited, or not possible, in other feed-through technologies. The advantage of this can improve technology by helping to create more accurate and stable sub-atomic particle detection, and tracking chambers, with a more economic price point.

According to some embodiments; method 100 can be implemented using the components of the drift tube assembly 50. Feeding the signal wire through the drift chamber (s100) is performed by feeding signal wire 5 in the first end 20 of carbon drift tube 9, through the length of the interior of drift tube 9 and out the drift tube second end 30.

Extending the first dielectric tube from the drift tube first end (s120) is achieved using the first drift tube end cap assembly 21. First, the end cap feed through wall 8 is press fit into the drift tube first end 20 and glued in place so as to hermetically seal the feedthrough wall to the tube first end. Then, the first dielectric tube 1 is thread onto signal wire 5 and slid into the feedthrough passageway 27 to the required position. First dielectric tube 1 is hermetically sealed and fixed in position in the feedthrough wall cap by tightening compression ferrule 7 (previously thread on to the wire and dielectric tube) to compression fitting 6. In some embodiments, the feed through wall 8 can be fit and hermetically sealed to the first tube end 20 before feeding signal wire 5 through the dielectric tube and drift tube.

This same process of fitting the drift tube end cap assembly to drift tube 9 can be repeated for fitting second drift tube end cap assembly 31 to drift tube second end 30.

With both drift tube end cap assemblies 21, 31 in place, step 130 of method step 140 is performed by placing the signal wire under tension. This can be achieved in several ways. In some embodiments, an end of the signal wire 5 extending outside of drift tube end cap assembly 31 can be attached to a weight and hung from a pulley whilst the other end of the signal wire 5 extending outside of first drift tube end cap assembly 21 is held fixed in position under tension. In some embodiments, the signal wire first end extending outside of assembly 21 can be manually held in position under tension by gripping the signal wire first end with a pair of pliers or other gripping tool. In other embodiments, this can be achieved using an automated machine. With signal wire 5 held in tension, step 150 of setting together the first dielectric tube and the signal wire therein can then be performed.

In one embodiment, the dielectric tube is manufactured from a material, such as plastic, that is capable of being brought into a malleable/thick liquid state, with the induction of heat. In this manner, the dielectric tube and signal wire is settable together by heat crimping. Heat crimping is achieved by heating the first plastic tube to a semi-liquid state and applying an adequate force to the plastic so that a gas tight seal between sidewalls of the plastic tube and signal wire therebetween is provided. The same heat crimping process can be used to heat crimp, at a location outside the drift tube second end 30, the second plastic tube and signal wire therein together to form the gas tight seal. At this point, the drift tube is fully hermetically sealed with the signal wire securely fixed in place. In some embodiments, electrical connections to each distal end of the signal wire 5 are made by crimping each end of wire 5 to a respective electrical conductor (see electrical termination crimp 3 and electrical plug 4).

Embodiments of the present technology will advance technology because the price point for electric feed-throughs will be reduced dramatically due to the availability and ease of application of the technology outlined. The reduction in manufacturing price will advance wire chambers used in physics for sub-atomic particle detection and tracking systems.

The feed-through created is capable of applying tension to a wire during the forming and setting process. This gives the advantage of a set location and added durability which is limited, or not possible, in other feed-through technologies. The advantage of this can improve technology by helping to create more accurate and stable sub-atomic particle detection, and tracking chambers, with a more economic price point.

Figure 6:
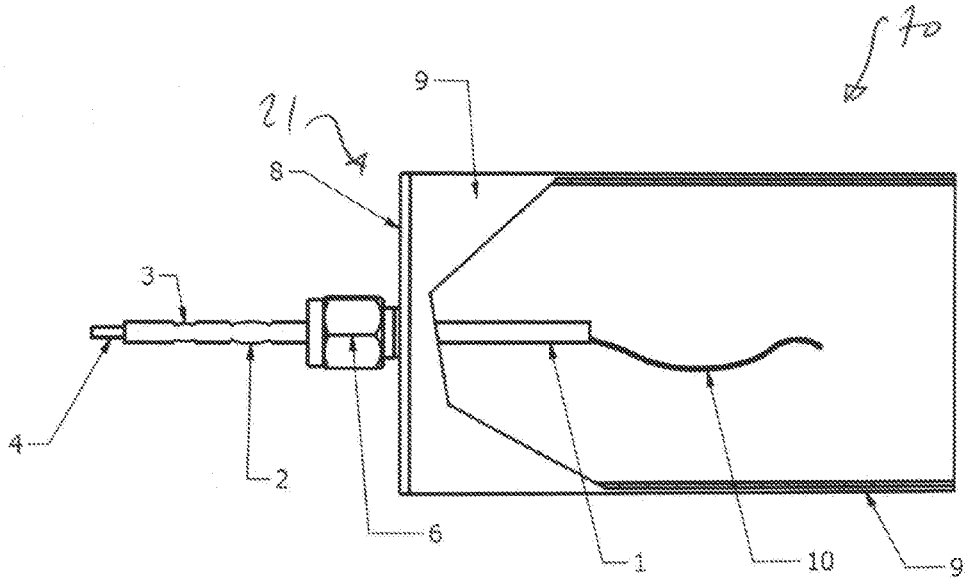
FIG. 6 is a perspective view showing in isolation a first drift tube end cap assembly according to one embodiment used in the drift tube of FIG. 4.

In other embodiments, the dielectric tube 1 and signal wire 5 are set together by heating crimping, or other process, without the signal wire being under tension and without the signal wire extending all the way through the drift tube (see drift tube assembly 70 of FIG. 6).

Figure 7:
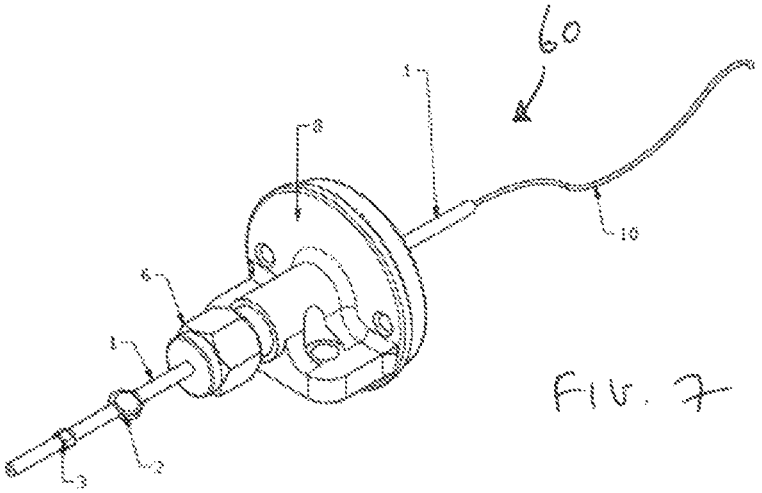
FIG. 7 is a perspective view of a drift tube end cap assembly according to another embodiment.
Figure 8:
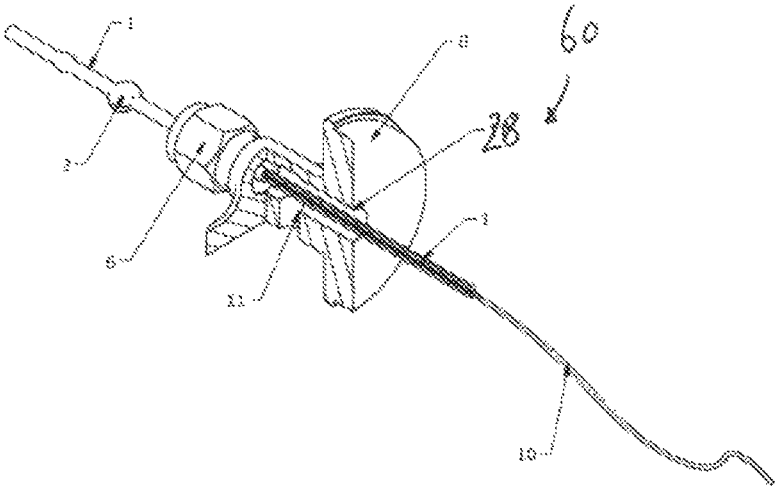
FIG. 8 is a perspective view cut away of a drift tube end cap assembly of FIG. 7.
Figure 9:
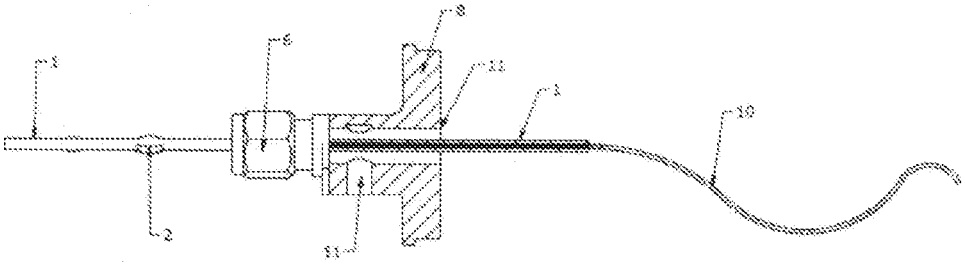
FIG. 9 is side view cut away of the drift tube end cap assembly of FIG. 7.

According to another aspect, a method of fitting a signal wire to a gas vessel, such as a drift tube, is provided. In one embodiment, a drift tube end cap assembly is provided having a gas port integrated therein. FIGS. 7-9 illustrate views of a drift tube end cap assembly according to one embodiment. The assembly 60 is identical to the assembly 21,31, 70 of any of the embodiments but includes a gas port 11 integrated into the feedthrough wall 8. As shown in FIG. 8, gas port 11 is integrated in feedthrough wall 8 and has a generally cylindrical body bridging the compression ferrule and wall 8. Gas port 11 has a cylindrical passageway 28 which extends coaxially between the feedthrough ferrule and feedthrough wall.

When dielectric tube 1 is placed in position in the feedthrough, dielectric tube 1 together with the feedthrough passageway 27 and the gas port passageway 28 are all coaxial with one another. Passageway 28 of the gas port has a diameter that is larger than the diameter of dielectric tube 1. In this manner, the gas port passageway 28 extends circumferentially around dielectric tube 1 and allows passage of gas between a side entrance of the port the gas port body and the exit of gas port at the distal end of passageway 28. In this embodiment, there is no need to tension the wire. The signal wire and dielectric tube are set together by heat crimping so as to seal the drift tube without the wire under tension. In such an arrangement, a drift tube end cap assembly at each end of the tube is not required.

In other embodiments, a drift tube end cap assembly at each end of the tube is provided and the wire is held under tension. One or both of the drift tube end cap assemblies can be a drift tube end cap assembly with gas port.

In some embodiments of the present technology, another type of gas vessel other than a drift chamber may be adopted. Other types of gas vessel may be used instead of the drift chamber in any of the embodiments of the methods and apparatus described herein. In some embodiments, the drift chambers or gas vessels maybe under high vacuum, ultra low vacuum, or low vacuum.

In summary the aforementioned embodiments of the present technology provide one or more of the following advantages: Low Cost fittings, Replaceable, non-permanent feed-through system; Reusable components; No mess due to lack of use of epoxy or solder; No internal solder needed, increasing durability by eliminating a failure point and reducing the chance of grounding issue; Adjustable sheath lengths and dielectric stand-offs; Holds tension in wire; The conductive adapter can be eliminated and the wire can feed directly into a computing device; Low contamination during installation due to low outgassing during production of feed-through.

It is to be understood that the described embodiments of the invention are illustrative only and that modifications thereof may occur to those skilled in the art. Accordingly, this invention is not to be regarded as limited to the embodiments disclosed, but is to be limited only as defined by the appended claims herein.

The invention claimed is:

1. A method for attaching a signal wire to a drift chamber, the method comprising feeding a signal wire through an end of a drift chamber;

feeding the signal wire through the dielectric tube;

extending the dielectric tube outwardly from the drift chamber end;

at a location on the outside of the drift chamber end, setting the extending dielectric tube and signal wire together to thereby fit the signal wire to the drift chamber end and gas seal the dielectric tube end;

feeding the signal wire through a second end of the drift chamber;

feeding the signal wire through the second dielectric tube;

extending the extending the second dielectric tube outwardly from the drift chamber second end; and at a second location on the outside of the drift chamber second end, setting the extending dielectric second tube and signal wire together to thereby fit the signal wire to the drift chamber second end and gas seal the dielectric second tube.

2. The method of claim 1, wherein setting the dielectric tube and signal wire together comprises:

heating at said location, material of the dielectric tube to a semi-liquid or liquid state and heat crimping the heated dielectric tube material and the signal wire therebetween together; and cooling the crimped dielectric tube to solidify the heated dielectric material.

3. The method of claim 1, wherein feeding a signal wire through an end of a drift chamber comprises applying a feedthrough wall fitting to the end of the drift chamber; and feeding the signal wire through a passageway of the feedthrough wall fitting.

4. The method of claim 3, wherein feeding the signal wire through the dielectric tube comprises threading the dielectric tube onto the signal wire fed through the drift chamber end.

5. The method of claim 4, wherein extending the dielectric tube outwardly from the drift chamber end comprises hermetically fitting the dielectric tube coaxially in the feedthrough wall passageway.

6. The method of claim 4, wherein extending the dielectric tube outwardly from the drift chamber end comprises hermetically fitting the dielectric tube in the feedthrough wall passageway coaxially with the feedthrough passageway and the gas port passageway; the gas port passageway having a diameter greater than the dielectric tube.

7. The method of claim 6, wherein setting the dielectric tube and signal wire together comprises:

heating at said location, material of the dielectric tube to a semi-liquid or liquid state and heat crimping the heated dielectric tube material and the signal wire therebetween together; and cooling the crimped dielectric tube to solidify the heated dielectric material.

8. The method of claim 1 further comprising tensioning the signal wire fed through the drift chamber end preparatory to setting said extending dielectric tube and signal wire together.

9. The method of claim 8 further comprising tensioning the signal wire fed through the drift chamber second end preparatory to setting said extending dielectric second tube and signal wire together.

10. The method of claim 9, wherein setting the drift chamber and the dielectric second tube and signal wire together comprises:

heating at said second location, material of the dielectric second tube to a semi-liquid or liquid state and heat crimping the heated dielectric second tube material and the signal wire therebetween together; and cooling the crimped dielectric tube to solidify the heated dielectric material.

11. The method of claim 10, wherein feeding a signal wire through the second end of a drift chamber comprises applying a second feedthrough wall fitting to the second end of the drift chamber; and feeding the signal wire through a passageway of the second feedthrough wall fitting.

12. The method of claim 11, wherein feeding the signal wire through the dielectric second tube comprises threading the dielectric second tube onto the signal wire fed through the drift chamber second end.

13. The method of claim 12, wherein extending the dielectric second tube outwardly from the drift chamber end comprises hermetically fitting the dielectric second tube coaxially in the second feedthrough wall passageway.

14. The method of claim 1, wherein feeding a signal wire through an end of a drift chamber comprises applying a feedthrough wall fitting to the end of the drift chamber; and feeding the signal wire through a passageway of the feedthrough wall fitting; wherein said feedthrough wall includes a gas port passageway extending coaxially with the feedthrough wall fitting.

15. The method of claim 14, wherein feeding the signal wire through the dielectric tube comprises threading the dielectric tube onto the signal wire fed through the drift chamber end.

16. The method of claim 1, wherein extending the dielectric tube outwardly from the drift chamber end comprises inserting the dielectric tube through the feedthrough passageway into the drift chamber by an insertion distance and hermetically fitting the dielectric tube coaxially in the feedthrough wall passageway; the insertion distance being pre-determined according to the desired voltage stand off of the drift chamber.

17. The method of claim 1, wherein feeding a signal wire through an end of a drift chamber comprises feeding a signal wire through an end of a muon graphite drift tube.

* * * * *